United States Patent [19]

Spry

[11] Patent Number: 4,997,088

[45] Date of Patent: Mar. 5, 1991

[54] CLIP BOARD WEATHER PROTECTOR

[76] Inventor: Mary N. Spry, 404 Port Chester Dr., Columbia, S.C. 29203

[21] Appl. No.: 552,474

[22] Filed: Jul. 16, 1990

[51] Int. Cl.[5] ..... B65D 25/54

[52] U.S. Cl. ..... 206/449; 220/665; 281/45

[58] Field of Search ..... 206/232, 449, 451; 150/154; 220/665; 281/45, 51; 312/1

[56] References Cited

U.S. PATENT DOCUMENTS

| | | | |
|---|---|---|---|
| 1,186,642 | 6/1916 | Alamy | 220/665 |
| 1,294,879 | 2/1919 | Davis . | |
| 1,642,384 | 9/1927 | Pryor | 281/45 |
| 1,642,385 | 9/1927 | Pryor | 281/45 |
| 1,967,632 | 7/1934 | Simonson | 281/45 |
| 2,839,791 | 6/1958 | Lee . | |
| 3,620,498 | 11/1971 | Tunki | 248/278 |
| 3,827,551 | 8/1974 | Croft | 206/214 |
| 4,060,293 | 11/1977 | Waiters | 312/284 |
| 4,445,728 | 5/1984 | Bratton | 312/1 |
| 4,896,927 | 1/1990 | Liu et al. | 281/45 |

FOREIGN PATENT DOCUMENTS

| | | | |
|---|---|---|---|
| 2140350 | 11/1984 | United Kingdom | 281/51 |

*Primary Examiner*—Jimmy G. Foster
*Attorney, Agent, or Firm*—Benoni O. Reynolds

[57] ABSTRACT

A protective cover for a clip board which permits use of the clip board for writing during inclement weather. The cover is transparent and attaches to the side edges and rear edge of the clip board by means of U-shaped clamps having adjustable thumb screws. A top panel, left panel, right panel and rear panel form a box-like structure over the clip board leaving an opening at the front for access to the writing surface of the clip board. The left panel and right panel are hinged to the front panel in such a way as to allow these side panels to fold flat atop the front panel. Similarly, the rear panel is hinged to the top panel so as to permit the rear panel to fold flat under the top panel when removed from the clip board. Thus, this protective cover is collapsible and portable yet can be quickly assembled and attached to a clip board in case of bad weather out in the field. Sizes for legal or letter size clip boards would be available.

3 Claims, 1 Drawing Sheet

CLIP BOARD WEATHER PROTECTOR

BACKGROUND OF THE INVENTION (1) Field of the Invention

This invention relates to protective covers. In particular, it relates to protective covers for clip boards which permit access to and observation of the writing surface of the clip board during use of the cover.

(2) Description of the Prior Art

The use of covers to protect and yet observe documents or manual operations is found in the prior art. In 1971, Tunkl (U.S. Reg. No. 3,620,498) patented an information holder which fastens to the control column of an aircraft or other vehicle. The holder could be swiveled for best observation by the user. Waiters, in 1976, (U.S. Reg. No. 4,060,293) discloses a transparent shield which could be placed over a peeling operation, to protect the user from irritating emissions produced while peeling onions or the like. Bratton, in 1984, (U.S. Reg. No. 4,445,728) discloses an all weather clip board which has a transparent cover as an integral part of the clip board assembly.

None of the prior art devices addresses the problem of portability as does the present invention. The known devices are permanently mounted or bulky in structure, which would not answer the need of investigators or claims adjusters in the field for a protector cover which is easily carried and can be readily attached to, or detached from, standard size clip boards. The unique arrangement of hinges in the present invention provides a protective cover which is small in size and collapses into a relatively flat profile for ease of carrying. At the same time the present invention is readily assembled and easily attached to or detached from standard size clip boards such as used by these investigative personnel.

Prior art known to this inventor includes the following U.S. Pat. Nos.:

| | | |
|---|---|---|
| 1,294,879 | 2/1919 | Davis |
| 2,839,791 | 6/1958 | Lee |
| 3,620,498 | 11/1971 | Tunkl |
| 4,060,293 | 11/1977 | Waiters |
| 4,445,728 | 5/1984 | Bratton |

SUMMARY OF THE INVENTION

The present invention, the Clip Board Weather Protector, is a protective cover for a clip board which permits use of the clip board for writing during inclement weather. It is transparent, collapsible and portable. It is particularly useful to investigators and claims adjusters who must make notes on the spot while working in the field under sometimes adverse weather conditions.

The preferred embodiment of this invention is a protective cover, for a clip board having two side edges and a rear edge, comprising:

- a transparent enclosure means for protecting the writing surface of the clip board during inclement weather; and
- an attachment means, mounted on the enclosure means, for temporarily fastening the transparent enclosure means to the clip board.

Transparent enclosure means is a top panel to which is affixed a left panel, a right panel and a rear panel, forming a box-like structure over the clip board, which structure is open at the front, providing access for writing on the clip board.

Attachment means is a plurality of U-shaped clamps, mounted on the lower portions of the left panel, the right panel and the rear panel, which slip over the side edges and rear edge of the clip board. Each U-shaped clamp has an adjustable thumb screw for holding the protective cover to the clip board when the present invention is fully assembled.

To permit the structure of the present invention to collapse for storage and portability, the left panel and the right panel of the present invention are hinged to the top panel so as to fold back over the top of the top panel. Likewise, the rear panel of the present invention is hinged to the top panel so as to fold under the top panel, when the protective cover is removed from the clip-board. In its collapsed state, the present invention is relatively flat so that it could be carried under the clip board or slipped into a separate casing. In case of inclement weather, this Clip Board Weather Protector can be quickly unfolded and attached to a clip board with a minimum of inconvenience. Alternate sizes of the present invention would be available for legal size or letter size clip boards.

OBJECTIVES OF THE INVENTION

The objectives of the present invention are to provide a cover for the writing area of a clip board which:

(1) is accessible from the front and will provide a working area between the cover and the writing surface of the clip board;

(2) will protect documents held on the clip board from wind and rain;

(3) is transparent to permit observation by the user while writing or observing information thereon;

(4) is lightweight, collapsible and portable for ease of transporting by investigators or adjusters in the field;

(5) can be easily attached or detached from the clip board without the need for special tools;

(6) will be available for legal or letter size clip boards.

Other objectives and advantages of the present invention will be apparent during the course of the following detailed description.

DETAILED DESCRIPTION OF THE PREFERRED EMBODIMENT OF THE INVENTION

Figure 1:
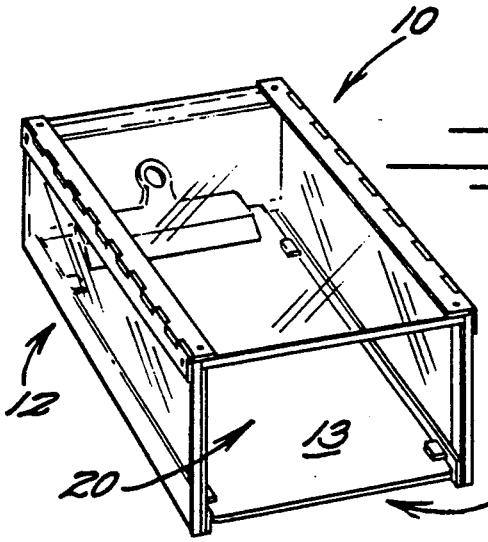
FIG. 1 is a perspective view from the left front of a protective cover for a clip board constructed in accordance with the principles of the present invention, detachably mounted on a standard size clip board.

The present invention is a transparent protective cover which is lightweight and collapsible and can be easily and quickly installed on, or removed from, a conventional legal size or letter size clip board. The protective cover enables an investigator or claims adjuster to take notes and peruse documents on the clip board under windy or rainy weather conditions. Throughout the following detailed description of the present invention, like reference numerals are used to denote like parts disclosed in the accompanying drawings, FIGS. 1 and 2.

As shown in FIG. 1, the protective cover of the present invention, shown generally at reference numeral 10, is used in combination with a standard legal or letter size clip board, shown generally at reference numeral 11. Protective cover 10 has a transparent enclosure means, shown generally at reference numeral 12, for protecting writing surface 13 of clip board 11 during inclement weather. In addition, protective cover 10 has an attachment means, shown generally at reference numeral 14, which is mounted on transparent enclosure means 12, for temporarily fastening transparent enclosure means 12 to clip board 11.

Figure 2:
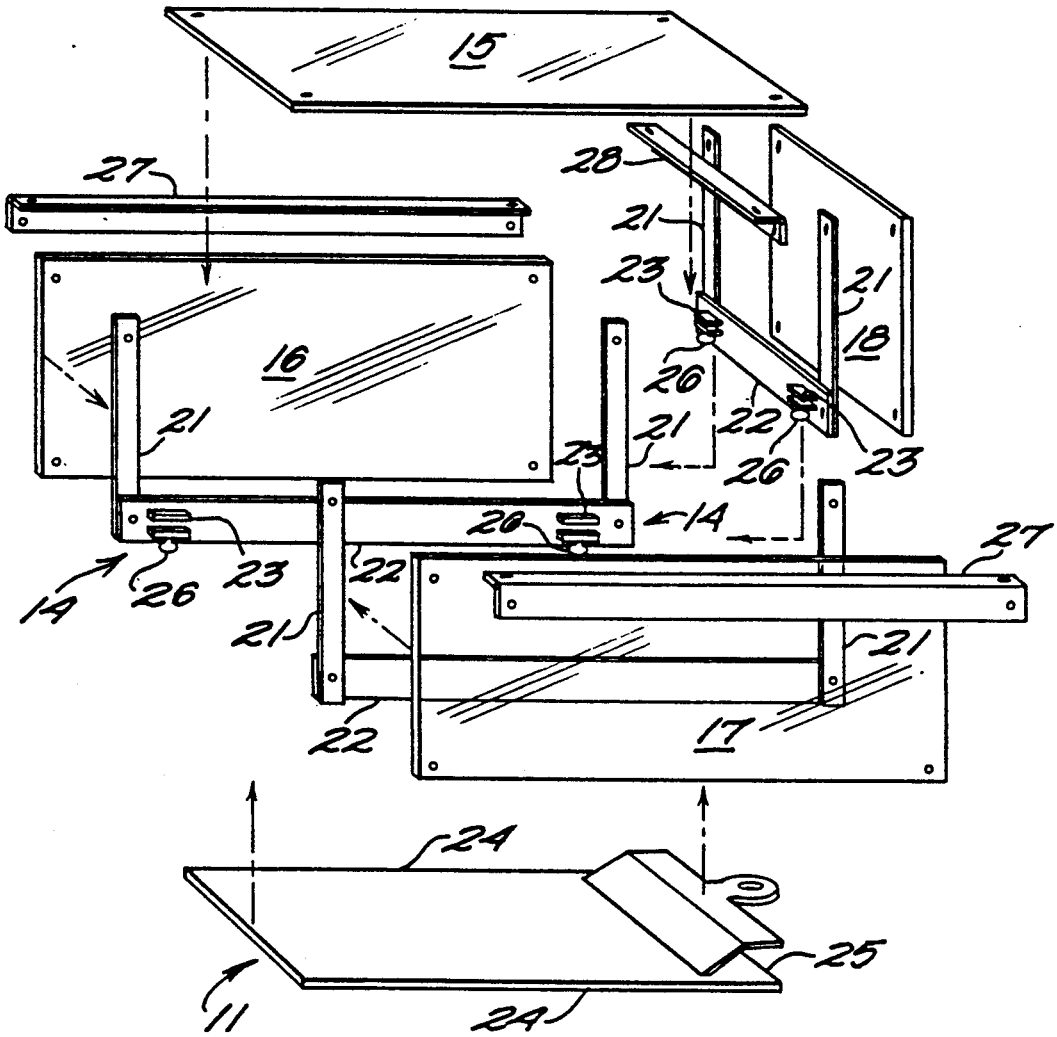
FIG. 2 is an exploded view of the present invention from the right side showing the transparent panels, hinges, vertical supports, horizontal supports and U-shaped clamps.

As shown in FIGS. 1 and 2, transparent enclosure means 12 is a top panel 15 to which is affixed a left panel 16, a right panel 17 and a rear panel 18. The four panels, 15, 16, 17 and 18, form a box-like structure, shown generally at reference numeral 19, over clip board 11. Panels 15, 16, 17 and 18 are made of a plastic material, such as a sheet of thermoplastic polymer, which is strong, lightweight and scratch resistant. Structure 19 is open at the front, shown generally at reference numeral 20, providing access by the user for writing on clip board 11. Left panel 16, right panel 17 and rear panel 18 are each reinforced at opposing ends by vertical supports 21, riveted to the inner side of each of the panels at their extreme ends. Similarly, each of these same three panels is further reinforced by horizontal supports 22, riveted to the inner side of each of the panels at the extreme bottom edge. Vertical supports 21 and horizontal supports 22 are made of a light weight metal such as aluminum. The space enclosed by structure 19 provides ample room for the user to reach inside protective cover 10 for writing or moving documents.

As best shown in FIG. 2, attachment means 14 is a plurality of U-shaped clamps 23, mounted on the lower portions of left panel 16, right panel 17 and rear panel 18 by fusion to the inside of each horizontal support 22 at two or more places. U-shaped clamps 23 slip over side edges 24 and rear edge 25 of clip board 11. Each U-shaped clamp 23 has an adjustable thumb screw 26 for holding protective cover 10 to clip board 11 when the present invention is fully assembled.

Although transparent enclosure means 12 and attachment means 14 of the present invention could be molded as a single unit and slipped over clip board 11 from the rear, the preferred embodiment of the present invention is made collapsible for ease of storage and transportation by the user. Side hinges 27 affixes left panel 16 and right panel 17 to top panel 15 and rear hinge 28 affixes rear panel 18 to top panel 15. Preferably hinges 27 and 28 are piano type hinges made of brass or aluminum for their strength and ease of operation. One of side hinges 27 is mounted higher on its respective left or right panel than the opposite side hinge 27 so that left panel 16 and right panel 17 will fold upwardly over front panel 15 and lie flat thereon without interfering with one another, when protective cover 10 is removed from clip board 11. Rear hinge 28 is mounted underneath the rear edge of top panel 15 so that rear panel 18 folds inwardly, underneath front panel 15, and nestles flatly against the bottom of top panel 15. Thus folded, the present invention presents a relatively flat tier of panels which slips easily under clip board 11 or into a separate carrying case (not shown).

To attach protective cover 10, the user need only unfold left panel 16, right panel 17 and rear panel 18 and slip U-shaped clamps 23 over the side edges 24 and rear edge 25 of clip board 11. Thumb screw 26 on each U-shaped clamp 23 is then tightened to hold protective cover 10 in place atop clip board 11. This procedure is merely reversed to quickly remove and store protective cover 10, if the cover is no longer needed.

I claim:

1. A protective cover, for a clip board having two side edges and a rear edge, comprising:

a transparent enclosure means for protecting the writing surface of said clip board during inclement weather comprising a top panel to which is affixed a left panel, a right panel and a rear panel, forming a box-like structure over said clip board, which structure is open at the front, providing access for writing on said clip board; and an attachment means, mounted on said enclosure means, for temporarily fastening said transparent enclosure means to said clip board, comprising a plurality of U-shaped clamps, mounted on the lower portions of said left panel; said right panel and said rear panel, which slip over the side edges and rear edge of said clip board.

2. The protective cover of claim 1 wherein said left panel and said right panel are hinged to said top panel so as to fold back over the top of said top panel and said rear panel is hinged to said top panel so as to fold under said top panel, when said protective cover is removed from said clip-board.

3. The protective cover of said claim 2 wherein each said U-shaped clamp has an adjustable thumb screw for holding said protective cover to said clip board when fully assembled.

* * * * *